US009829000B2

(12) United States Patent
Moormann

(10) Patent No.: US 9,829,000 B2
(45) Date of Patent: Nov. 28, 2017

(54) BILGE PUMP HAVING CONCEALED AIR-LOCK VENT

(71) Applicant: Flow Control LLC., Beverly, MA (US)

(72) Inventor: Randall H. Moormann, Georgetown, MA (US)

(73) Assignee: Flow Control LLC., Beverly, MA (US)

( * ) Notice: Subject to any disclaimer, the term of this patent is extended or adjusted under 35 U.S.C. 154(b) by 527 days.

(21) Appl. No.: 14/193,269

(22) Filed: Feb. 28, 2014

(65) Prior Publication Data

US 2015/0247502 A1 Sep. 3, 2015

(51) Int. Cl.

*F04D 29/70* (2006.01)
*F04D 9/00* (2006.01)
*F04D 29/40* (2006.01)

(52) U.S. Cl.

CPC ..... *F04D 9/003* (2013.01); *F04D 29/406* (2013.01)

(58) Field of Classification Search

CPC .... F04D 29/426; F04D 29/605; F04D 29/708; F04B 39/14

See application file for complete search history.

(56) References Cited

U.S. PATENT DOCUMENTS

| | | | | |
|---|---|---|---|---|
| 1,467,575 | A | 9/1923 | Flanders | |
| 1,993,267 | A | 3/1935 | Ferguson | |
| 2,061,521 | A | 11/1936 | Saxe | |
| 2,100,365 | A | 11/1937 | Stratton | |
| 2,451,030 | A | 10/1948 | Jones | |
| 2,985,108 | A | 5/1961 | Stoner et al. | |
| 3,246,606 | A | 4/1966 | Nielsen | |
| 3,279,386 | A | 10/1966 | Rupp et al. | |
| 4,013,383 | A * | 3/1977 | Rule | F04D 9/001 417/366 |
| 4,637,778 | A | 1/1987 | Pollari | |
| 5,039,284 | A | 8/1991 | Talaski | |
| 6,038,993 | A | 3/2000 | Vento | |

(Continued)

FOREIGN PATENT DOCUMENTS

JP 199406017784 1/1994

OTHER PUBLICATIONS

JP 199406017784—English Language Abstract (1 pg).
JP 198901035096—English Language Abstract and notice from PAJ, full reference unavailable.

*Primary Examiner* — Justin Seabe
(74) *Attorney, Agent, or Firm* — Ware, Fressola, Maguire & Barber LLP

(57) ABSTRACT

The pump has a pump body having a pump body portion with a vent hole to allow air entrapped in the pump body to bleed out to atmosphere and allow liquid to fill the pump body in order to get the pump running, and also includes a tab receiving portion having a rim defining an opening; and a pump/strainer assembly that includes a base with slots/openings formed therein to receive and strain liquid to be pumped, and includes a strainer retaining tab with a raised rim to be received in the opening of the tab receiving portion and circumferentially engaged by the rim of the opening to hold together the pump/strainer assembly and the pump body. The at least one tab receiving portion and the strainer retaining tab are dimensioned to conceal the vent hole and substantially prevent the liquid from bleeding through the vent hole and squirting outside of the pump body when the pump is running.

14 Claims, 2 Drawing Sheets

(56) References Cited

U.S. PATENT DOCUMENTS

| | | | | |
|---|---|---|---|---|
| 6,715,994 | B2 * | 4/2004 | Patel | F04B 39/121 417/12 |
| 7,059,824 | B2 | 6/2006 | Ramacciotti | |
| 7,232,288 | B2 | 6/2007 | Tibban | |
| 2009/0050042 | A1 | 2/2009 | Waldecker | |
| 2010/0028166 | A1 | 2/2010 | Collins et al. | |
| 2012/0207590 | A1 | 8/2012 | Pohler et al. | |
| 2013/0052060 | A1 | 2/2013 | Meza et al. | |
| 2013/0336763 | A1 | 12/2013 | Lopes et al. | |
| 2014/0037434 | A1 * | 2/2014 | Eslinger | F04D 13/10 415/168.2 |

* cited by examiner

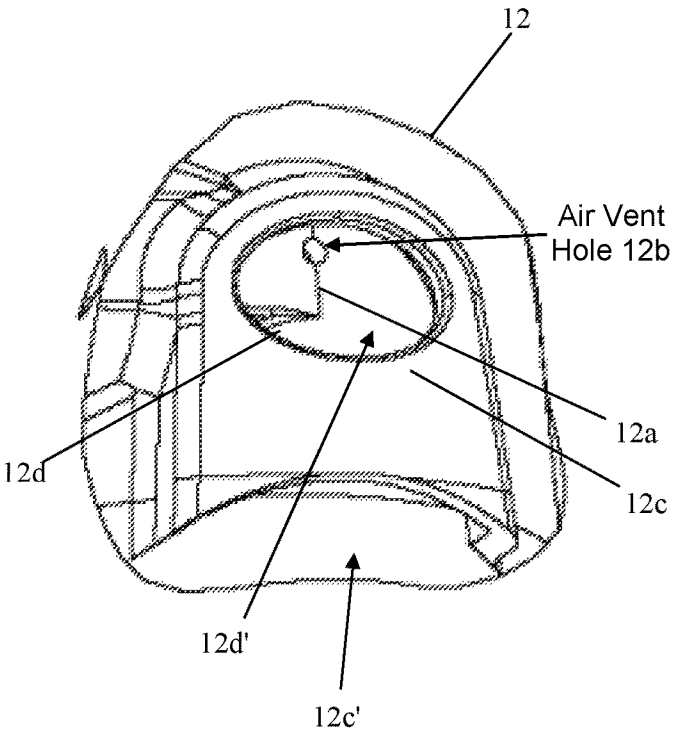
Fig. 2b (Not engaged)
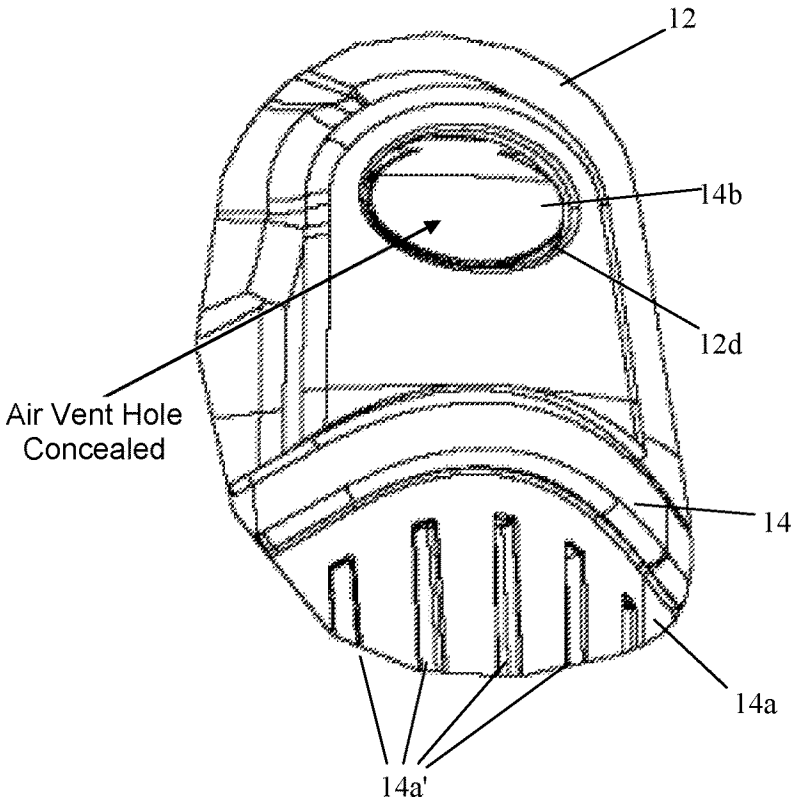
Fig. 2a (Fully engaged)
Figure 2 (Scale: 2:00)

BILGE PUMP HAVING CONCEALED AIR-LOCK VENT

BACKGROUND OF THE INVENTION

1. Field of the Invention

This invention relates to a pump; and more particularly, relates to a centrifugal pump.

2. Description of Related Art

A centrifugal pump cannot begin pumping water until its impeller is immersed in water. In the operation of the centrifugal pump, there are cases in which the impeller is prevented from engaging any water by air entrapped in the pump's housing or body. This situation is known as air lock. In view of this, there is a need for a way to prevent air lock, e.g., in centrifugal pumps.

SUMMARY OF THE INVENTION

To overcome this air lock condition, the pump must release this entrapped air, the air must be allowed to "bleed" out to the atmosphere allowing the water to rise and engage the impeller. By way of example, a related patent application Ser. No. 14/193,210, filed on 28 Feb. 2014, assigned to the assignee of the present application, discloses a technique for solving the aforementioned air lock problem, which is incorporated by reference in its entirety. See also patent application Ser. No. 13/917,970, filed 14 Jun. 2013, which is also assigned to the assignee of the present application, and which is also incorporated by reference in its entirety.

The instant application builds on the techniques set forth in the aforementioned related applications.

By way of example, and according to some embodiments, the present invention may take the form of a pump, including a bilge pump having an impeller and an anti-airlock vent or valve assembly, featuring a pump body and a pump/strainer assembly.

The pump body includes a pump body portion configured with a vent hole formed therein to allow air entrapped in the pump body to bleed out to atmosphere and allow liquid to fill the pump body in order to get the pump running, and also includes at least one tab receiving portion configured with a rim defining or forming an opening.

The pump/strainer assembly includes a base configured with one or more slots/openings formed therein to receive and/or strain liquid to be pumped, and also includes at least one strainer retaining tab configured with a raised rim to be received in the opening of the at least one tab receiving portion and circumferentially engaged by the rim defining the opening to hold together the pump/strainer assembly and the pump body. The at least one tab receiving portion and at least one strainer retaining tab may also be configured and dimensioned to conceal the vent hole and substantially prevent the liquid from bleeding through the vent hole and squirting outside of the pump body when the pump is running.

In effect, the strainer retaining tab has a primarily function of holding together the pump body and pump/strainer assembly, while also functioning to conceal the vent hole According to some embodiments, the present invention may include one or more of the following features:

The at least one tab receiving portion may be configured to receive and flex the at least one strainer retaining tab inwardly, and the at least one strainer retaining tab may be configured to flex outwardly when received in the opening of the at least one tab receiving portion so that the raised rim circumferentially engages the rim defining the opening.

The pump body portion may be molded with the vent hole formed therein.

The at least one tab receiving portion may include two tab receiving portions; and the at least one strainer retaining tab may include two strainer retaining tabs, each tab receiving portion configured to receive a respective strainer retaining tab.

The two tab receiving portions may be configured on opposite sides of the pump body; and the two strainer retaining tabs may be similarly configured on opposite sides of pump/strainer assembly.

The pump body may include a pump housing outlet configured at substantially the same level as the vent hole.

BRIEF DESCRIPTION OF THE DRAWING

The drawing, which is not necessarily to scale, include the following Figures:

FIG. 1*a* is a diagram of a pump having a pump body engaged with a pump/strainer assembly, according to some embodiments of the present invention; and where FIG. 1*b* is a diagram of the pump in FIG. 1*a* having the pump body not engaged with the pump/strainer assembly, according to some embodiments of the present invention.

FIG. 2 includes FIGS. 2*a* and 2*b*, where FIG. 2*a* is an exploded view of part of the pump in FIG. 1*a* showing how the air vent hole is concealed when the pump body is engaged with the pump/strainer assembly, according to some embodiments of the present invention; and where FIG. 2*b* is an exploded view of part of the pump in FIG. 1*b* showing the air vent hole when the pump body is not engaged with the pump/strainer assembly, according to some embodiments of the present invention.

Figure 1:
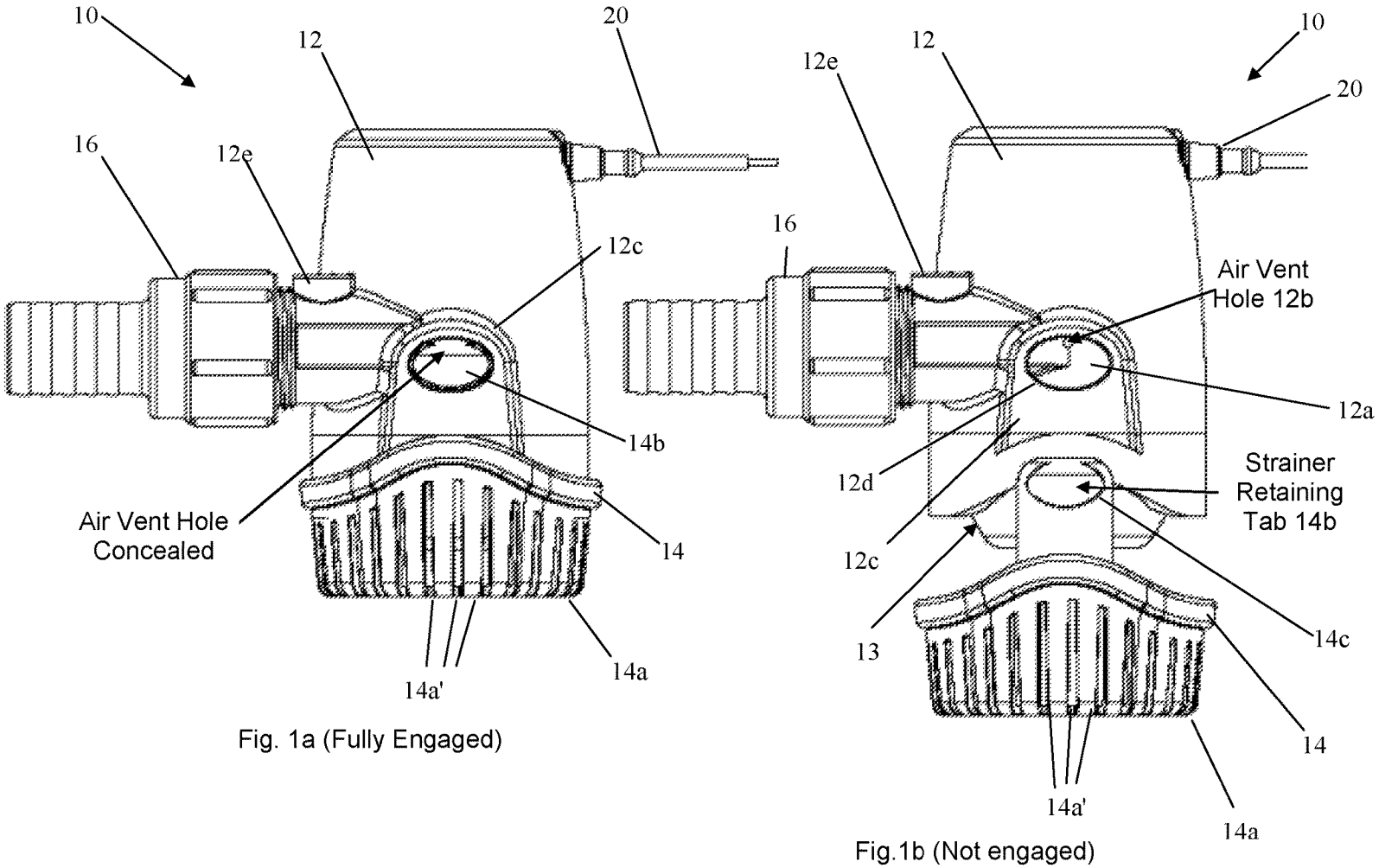
FIG. 1 includes FIGS. 1*a* and 1*b*, where

There is a scale of about 2 to 1 between the part of the pump shown in FIG. 2 and that shown in FIG. 1.

In the following description of the exemplary embodiment, reference is made to the accompanying drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

In summary, in the operation of running a pump, similar to when air is trapped in an upside down glass, the pump cannot begin pumping water until its impeller can engage the water being held back by the "bubble of air". To overcome this problem, entrapped air must be allowed to "bleed" out of the pump housing into the atmosphere allowing the water to rise into the pump housing and engage the impeller. One solution to this problem is to form an air vent that will allow the entrapped air to bleed out. Once water is flowing because of the air being evacuated, the vent hole will bleed or squirt water through to the outside of the pump. According to the present invention, because strainer retaining tabs are covering this zone, this bleeding is concealed and stops the water from squirting outside the pump housing.

In particular, and by way of example, FIG. 1 shows a pump generally indicated as 10, e.g., which may include, or take the form of, a centrifugal pump having an impeller, such as that typically used as a bilge pump. The pump 10 may include two basic components, i.e., a pump body 12 and a pump/strainer assembly 14.

The pump body 12 includes a pump body portion 12*a* configured with a vent hole 12*b* formed therein within the pump body to allow air entrapped in the pump body 12 to bleed out to atmosphere and allow liquid to fill the pump body 12 in order to get the pump 10 running, and also includes at least one tab receiving portion 12*c* configured with a rim 12*d* defining or forming an opening 12*d*'. See also FIG. 2. By way of example, the air may be entrapped in a suction chamber generally indicated as 13 of the pump body 12 where the impeller is configured to rotate in order to pump the liquid from the suction chamber, through the pump body 12, to a pump housing outlet 12*e*, e.g., having a nozzle 16 arranged thereon.

The pump/strainer assembly 14 includes a base 14*a* configured with one or more slots/openings 14*a*' formed therein to receive and strain liquid to be pumped into the suction chamber 13, and also includes at least one strainer retaining tab 14*b* configured with a raised rim 14*c* to be received in the opening 12*d*' of the at least one tab receiving portion 12*c* and circumferentially engaged by the rim 12*d* defining the opening 12*d*' to hold together the pump/strainer assembly 14 and the pump body 12, consistent with that shown in FIGS. 1*a* and 2*a*. The at least one tab receiving portion 12*c* and at least one strainer retaining tab 14*b* may also be configured and dimensioned to conceal the vent hole 12*b* and substantially prevent the liquid from bleeding through the vent hole 12*b* and squirting outside of the pump body 12 when the pump 10 is running and pumping the liquid. By way of example, the strainer retaining tab 14*b* may be dimensioned to fit substantially within the opening 12*d*', so that the rim 12*d* and the raised rim 14*c* are in close proximity to one another, consistent with that shown in FIGS. 1*a* and 2*a*.

The strainer retaining tab 14*b* extends from the base 14*a* and is configured to be a flexible component. In operation, when the pump/strainer assembly 14 and the pump body 12 are coupled together, a channel portion 12*c*' of the tab receiving portion 12*c* receives and flexes the strainer retaining tab 14*b* inwardly. The strainer retaining tab 14*b* then flexes outwardly when received in the opening 12*d*' of the at least one tab receiving portion 12*c* so that the raised rim 14*c* circumferentially engages the rim 12*d* defining the opening 12*d*', e.g., in a so-called interference fit. The pump/strainer assembly 14 and the pump body 12 may be de-coupled by pushing the strainer retaining tab 14*b* inwardly into the opening 12*d*', so that the rim 12*d* and the raised rim 14*c* disengage, the pump/strainer assembly 14 and the pump body 12 are pulled apart, and the strainer retaining tab 14*b* is pulled out of the channel portion 12*c*' of the tab receiving portion 12*c*.

According to some embodiments, the pump body portion 12*a* may be molded with the vent hole 12*b* formed therein. The pump housing outlet 12*e* may be configured at substantially the same level as the vent hole 12*b*, consistent with that shown in FIG. 1*b*, for providing the liquid being pumped through a nozzle 16. In FIG. 1, the nozzle 16 is shown being screwed onto the pump housing outlet 12*e*.

The at least one tab receiving portion 12*c* may include two tab receiving portions 12*c*; and the at least one strainer retaining tab 14*b* may include two strainer retaining tabs 14*b*, each tab receiving portion configured to receive a respective strainer retaining tab. In FIGS. 1-2, only one tab receiving portion 12*c* and one corresponding strainer retaining tab 14*b* are shown. The two tab receiving portions 12*c* may be configured on opposite sides of the pump body 12; and the two strainer retaining tabs 14*b* may be configured on opposite sides of pump/strainer assembly 14. Embodiments are also envisioned, and the scope of the invention is intended to include, using three or more tab receiving portions 12*c* and corresponding strainer retaining tabs 14*b*, e.g., arranged equidistantly around the pump body 12 and the pump/strainer assembly 14.

The pump 10, like that shown in FIG. 1, may also include, e.g., other parts, elements, components, or circuits that do not form part of the underlying invention, including an impeller, a motor, diaphragm pumping components, pressure transducers, wiring for coupling the motor to a control circuit, and are thus not identified and described in detail herein.

Moreover, pumps having motors and impeller arranged or configured thereon are known in the art, and the scope of the invention is not intended to be limited to any particular type or kind thereof either now known or later developed in the future.

See also another related patent application Ser. No. 14/193,324, filed on 28 Feb. 2014, showing the same pump as that shown in FIGS. 1*a* and 1*b* herein, which discloses a technique for using a duckbill-type check valve for solving a backflow problem, is assigned to the assignee of the present application, and is incorporated by reference in its entirety.

Possible Applications

Possible applications are envisioned to include any type or kind of pump or rotary equipment that may be submerged and contain trapped air, e.g., in its housing or impeller housing, including but not limited to centrifugal pumps or other types or kinds of submersible pumps either now known or later developed in the future, including bilge pumps or utility pumps.

Scope of the Invention

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

I claim:

1. A pump comprising:

a pump body comprising:

a chamber;

a vent hole formed in the pump body to allow air entrapped in the chamber to bleed out to atmosphere and allow liquid to fill the chamber in order to get the pump running, and at least one tab receiving portion comprising:

a rim defining or forming an opening; and a channel portion;

a pump/strainer assembly configured to be coupled to the pump body comprising:

a base configured with one or more slots/openings formed therein to receive and strain liquid to be pumped, and at least one strainer retaining tab comprising a raised rim; wherein to couple the pump/strainer assembly to the pump body, the channel portion of the at least one tab receiving portion is configured to receive the at least one strainer retaining tab and the raised rim of the at least one strainer retaining tab is configured to be received in the opening of the at least one tab receiving portion and circumferentially engaged by the rim of the at least one tab receiving portion to hold together the pump/strainer assembly and the pump body, and wherein the at least one tab receiving portion and the at least one strainer retaining tab are configured and dimensioned to conceal the vent hole and substantially prevent the liquid from bleeding through the vent hole and squirting outside of the chamber when the pump is running, wherein the raised rim of the at least one strainer retaining tab is configured to be received in the opening of the at least one tab receiving portion and to be circumferentially engaged by the rim of the at least one tab receiving portion in an interference fit.

2. A pump according to claim 1, wherein the channel portion of at least one tab receiving portion is configured to receive and flex the at least one strainer retaining tab inwardly, and the at least one strainer retaining tab is configured to flex outwardly when received in the opening of the at least one tab receiving portion so that the raised rim circumferentially engages the rim defining the opening.

3. A pump according to claim 1, wherein the pump body is molded with the vent hole formed therein.

4. A pump according to claim 1, wherein the at least one tab receiving portion comprises two tab receiving portions; and the at least one strainer retaining tab comprises two strainer retaining tabs, each tab receiving portion configured to receive a respective strainer retaining tab.

5. A pump according to claim 4, wherein the two tab receiving portions are configured on opposite sides of the pump body; and the two strainer retaining tabs are configured on opposite sides of pump/strainer assembly.

6. A pump according to claim 1, wherein the pump body comprises a pump housing outlet substantially aligned with the vent hole.

7. A pump according to claim 1, wherein the pump is a bilge pump.

8. A pump according to claim 1, wherein the pump/strainer assembly and the pump body are decoupled by pushing the at least one strainer retaining tab inwardly into the opening, so that the rim and the raised rim disengage and the at least one strainer retaining tab is pulled out of the channel portion of the at least one tab receiving portion.

9. A pump according to claim 1, wherein the chamber is a suction chamber in which an impeller is configured to rotate in order to pump liquid from the suction chamber through the pump body.

10. A pump according to claim 9, wherein the liquid is pumped from the suction chamber through the pump body to a pump housing outlet having a nozzle arranged thereon.

11. A pump according to claim 10, wherein the one or more slots/openings of the pump/strainer assembly are configured to receive and strain liquid to be pumped into the suction chamber.

12. A pump according to claim 1, wherein the at least one strainer retaining tab extends from the base of the pump/strainer assembly.

13. A pump according to claim 1, wherein the raised rim of the at least one strainer retaining tab projects outwardly from a body section of the at least one strainer retaining tab and comprises a circumference.

14. A pump according to claim 13, wherein the opening defined by the rim of the at least one tab receiving portion engages the circumference of the raised rim of the at least one strainer tab.

* * * * *